US010833427B2

(12) United States Patent
Sato et al.

(10) Patent No.: US 10,833,427 B2
(45) **Date of Patent: *Nov. 10, 2020**

(54) TERMINAL-EQUIPPED ELECTRIC WIRE AND METHOD OF MANUFACTURING TERMINAL-EQUIPPED ELECTRIC WIRE

(71) Applicant: YAZAKI CORPORATION, Tokyo (JP)

(72) Inventors: Tomoya Sato, Shizuoka (JP); Naoki Ito, Shizuoka (JP); Yasunori Nabeta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/192,872

(22) Filed: Nov. 16, 2018

(65) Prior Publication Data

US 2019/0165489 A1 May 30, 2019

(30) Foreign Application Priority Data

Nov. 28, 2017 (JP) ..... 2017-227436

(51) Int. Cl.

| | |
|---|---|
| ***H01R 4/18*** | (2006.01) |
| ***H01R 43/048*** | (2006.01) |
| ***H01R 43/28*** | (2006.01) |
| ***H01R 11/12*** | (2006.01) |

(52) U.S. Cl.

CPC ..... *H01R 4/183* (2013.01); *H01R 11/12* (2013.01); *H01R 43/0484* (2013.01); *H01R 43/28* (2013.01)

(58) Field of Classification Search

CPC .... H01R 4/183; H01R 43/0484; H01R 11/12; H01R 43/28

USPC ..... 439/868, 878, 879

See application file for complete search history.

(56) References Cited

U.S. PATENT DOCUMENTS

| | | | | |
|---|---|---|---|---|
| 9,318,815 | B2 * | 4/2016 | Mitose | H01R 4/185 |
| 9,502,784 | B2 * | 11/2016 | Ohnuma | H01R 4/62 |
| 10,559,896 | B2 * | 2/2020 | Sato | H01R 4/185 |
| 2010/0055998 | A1 * | 3/2010 | Aihara | H01R 4/185 439/877 |

(Continued)

FOREIGN PATENT DOCUMENTS

| | | |
|---|---|---|
| JP | 2009-231079 A | 10/2009 |
| JP | 2011-082127 A | 4/2011 |

(Continued)

*Primary Examiner* — Travis S Chambers

(74) *Attorney, Agent, or Firm* — Metrolex IP Law Group, PLLC

(57) ABSTRACT

A terminal-equipped electric wire includes at least one electric wire and a terminal including a wire barrel and installed on the electric wire. The electric wire includes a sheath; a conductor having a covered portion covered by the sheath and an exposed portion exposed due to absence of the sheath over a predetermined length at a part of the electric wire in a longitudinal direction of the electric wire; and a bonded portion formed over a predetermined length at a part of the exposed portion, the bonded portion at which strands of the conductor are bonded. An end of the wire barrel on a sheath side is closer to the sheath than an end of the bonded portion on the sheath side. The wire barrel covers at least a part of the bonded portion.

8 Claims, 5 Drawing Sheets

(56) References Cited

U.S. PATENT DOCUMENTS

| | | | | |
|---|---|---|---|---|
| 2011/0094797 | A1* | 4/2011 | Otsuka | H01R 43/0207 174/84 C |
| 2012/0324727 | A1 | 12/2012 | Seifert et al. | |
| 2013/0025935 | A1* | 1/2013 | Takayama | H01R 4/184 174/75 R |
| 2019/0165490 | A1* | 5/2019 | Sato | H01R 4/185 |
| 2019/0165491 | A1* | 5/2019 | Sato | H01R 4/185 |
| 2019/0165532 | A1* | 5/2019 | Sato | H01R 43/0207 |
| 2019/0165533 | A1* | 5/2019 | Nabeta | H01R 43/0207 |
| 2019/0165535 | A1* | 5/2019 | Sato | H01R 43/048 |

FOREIGN PATENT DOCUMENTS

| | | | |
|---|---|---|---|
| JP | 2013-229282 | A | 11/2013 |
| WO | 2013/146640 | A1 | 10/2013 |

* cited by examiner

TERMINAL-EQUIPPED ELECTRIC WIRE AND METHOD OF MANUFACTURING TERMINAL-EQUIPPED ELECTRIC WIRE

CROSS REFERENCE TO RELATED APPLICATION

This application is based upon and claims the benefit of priority from the prior Japanese Patent Application No. 2017-227436, filed on Nov. 28, 2017, the entire contents of which are incorporated herein by reference.

BACKGROUND

1. Technical Field

The disclosure relates to a terminal-equipped electric wire and a method of manufacturing a terminal-equipped electric wire, and more particularly, to a method of installing a wire barrel of a terminal on a conductor in which a plurality of strands are bonded to form a bonded portion.

2. Related Art

JP 2009-231079 A discloses a terminal-equipped electric wire 301 as shown in FIGS. 1A to 2.

The terminal-equipped electric wire 301 is formed as follows. First, with respect to an electric wire 307 (see FIG. 1A) in which a sheath 303 is removed at one end portion and a conductor 305 (core wire) is exposed, an exposed tip portion of a conductor 305 is ultrasonically bonded to form a bonded portion 309 (see FIG. 1B).

That is, respective strands 311 are ultrasonically bonded at the tip portion of the conductor 305 constituted by a plurality of strands 311 to form a bonded portion 309.

A terminal-equipped electric wire 301 (see FIG. 1C) can be provided by caulking a wire barrel 313 at the bonded portion 309 and installing a terminal 315.

SUMMARY

In the terminal-equipped electric wire 301, cut of a strand (cut of the core wire) may occur at the end 317 (the end on the sheath 303 side) of the bonded portion 309 (see FIG. 1D).

That is, when caulking the wire barrel 313 to the electric wire 307 forming the bonded portion 309 and crimping the terminal 315, as shown in FIG. 1D, in a case where an end 317 of the bonded portion 309 (the boundary portion between the bonded portion 309 and the non-bonded portion) is located outside the wire barrel 313, the boundary portion 317 is pulled by crimping the terminal 315.

At the boundary portion 317, the value of the residual stress is increased due to the influence of the bonding process, and the strand 311 is easily disconnected. Further, at the boundary portion 317, the cross-sectional shape of the conductor 305 (the shape of the cross section represented by the plane orthogonal to the longitudinal direction) is suddenly changed, whereby stress concentration is likely to occur.

Then, when a tensile stress is generated in the strand 311 due to the crimping of the terminal 315, cut of the core wire occurs. Reference numeral 311A in FIG. 1D represents a strand for which cut of the core wire has occurred.

Further, as shown in FIG. 2, since the bonded portion 309 is formed at the center portion of the exposed conductor 305 in the longitudinal direction, even in the case where a non-bonded portion is present at the tip (left side in FIG. 2) of the electric wire 307, if the end 319 of the bonded portion 309 (the end opposite to the sheath 303) is located outside the wire barrel 313, by the crimping of the terminal 315, the boundary portion 319 between the bonded portion 309 and the non-bonded portion is pulled, whereby cut of the core wire will occur. Reference numeral 311B in FIG. 2 represents a strand for which cut of the core wire has occurred.

The disclosure is directed to a method and an apparatus which is capable of suppressing cut of a strand at a boundary of a bonded portion in a terminal-equipped electric wire or the like in which a bonded portion is formed in part of a conductor a wire barrel of the terminal is installed at the bonded portion.

A terminal-equipped electric wire in accordance with some embodiments includes at least one electric wire and a terminal including a wire barrel and installed on the electric wire. The electric wire includes: a sheath; a conductor having a covered portion covered by the sheath and an exposed portion exposed due to absence of the sheath over a predetermined length at a part of the electric wire in a longitudinal direction of the electric wire; and a bonded portion formed over a predetermined length at a part of the exposed portion, the bonded portion at which strands of the conductor are bonded. An end of the wire barrel on a sheath side is closer to the sheath than an end of the bonded portion on the sheath side. The wire barrel covers at least a part of the bonded portion.

An end portion of the wire barrel on the sheath side may have a bell mouth portion. An end of the bell mouth portion opposite to an end of the bell mouth portion on the sheath side may be closer to the sheath than the end of the bonded portion on the sheath side.

The longitudinal direction and a front-rear direction of the wire barrel may match with each other. The bonded portion may be located inside the wire barrel in the front-rear direction.

The at least one electric wire may include electric wires, the terminal may be a single terminal, and the single terminal may be installed on the electric wires.

A method of manufacturing a terminal-equipped electric wire in accordance with some embodiments includes: forming a bonded portion by bonding strands of a conductor at a part of an exposed portion of the conductor in a longitudinal direction of the electric wire, the exposed portion at which the conductor is exposed due to absence of a sheath over a predetermined length at a part of the electric wire in the longitudinal direction; and after the forming of the bonded portion, installing a terminal having a wire barrel on an electric wire so that the wire barrel covers at least part of the bonded portion wherein an end of the wire barrel located on a sheath side of the electric wire is located closer to the sheath than an end of the bonded portion on the sheath side.

According to the above configuration, it is possible to suppress cut of the strand at a boundary of a bonded portion in a terminal-equipped electric wire or the like in which part of a conductor is bonded to form a bonded portion, and a wire barrel of the terminal is installed at the bonded portion.

DETAILED DESCRIPTION

Figure 1A:
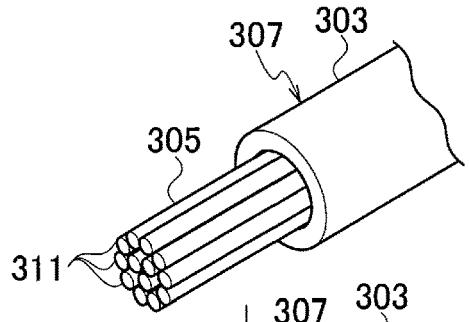
FIG. 1A PRIOR ART
FIGS. 1A to 1D are views of related terminal-equipped electric wires.
Figure 1B:
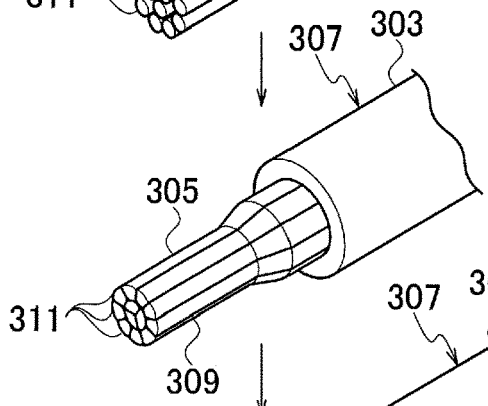
FIG. 1B PRIOR ART
Figure 1C:
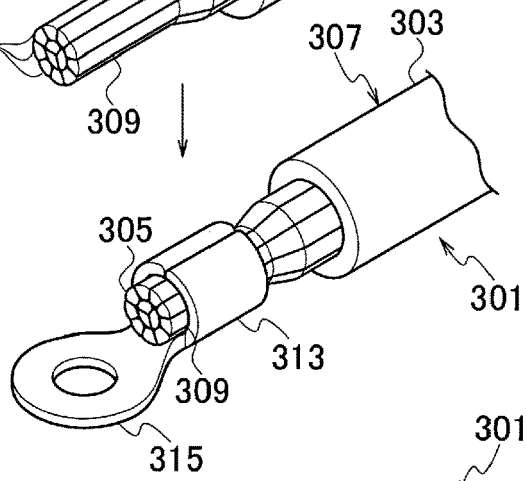
FIG. 1C PRIOR ART
Figure 1D:
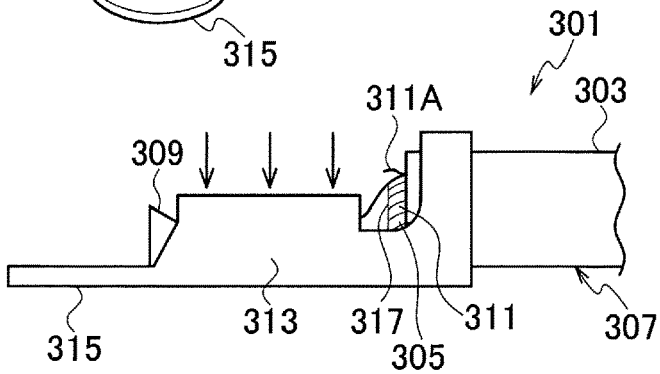
FIG. 1D PRIOR ART
Figure 2:
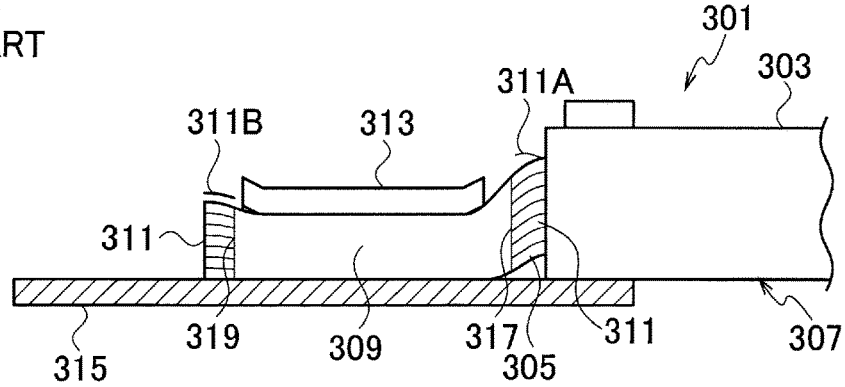
FIG. 2 PRIOR ART
FIG. 2 is a view of a related terminal-equipped electric wire.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 3:
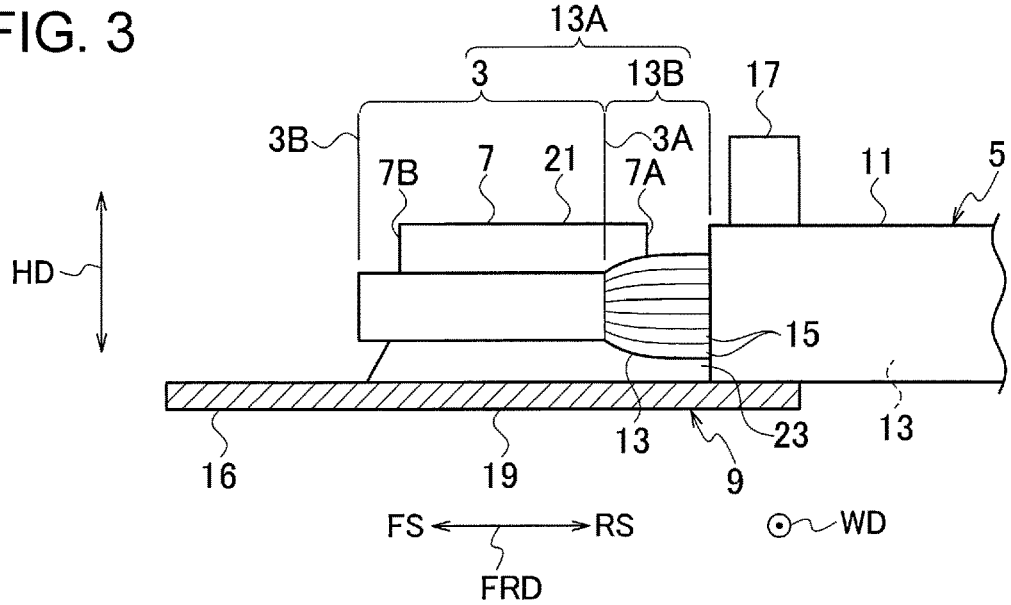
FIG. 3 is a view of a terminal-equipped electric wire according to an embodiment of the present invention and shows a state before a terminal is installed on an electric wire.
Figure 4:
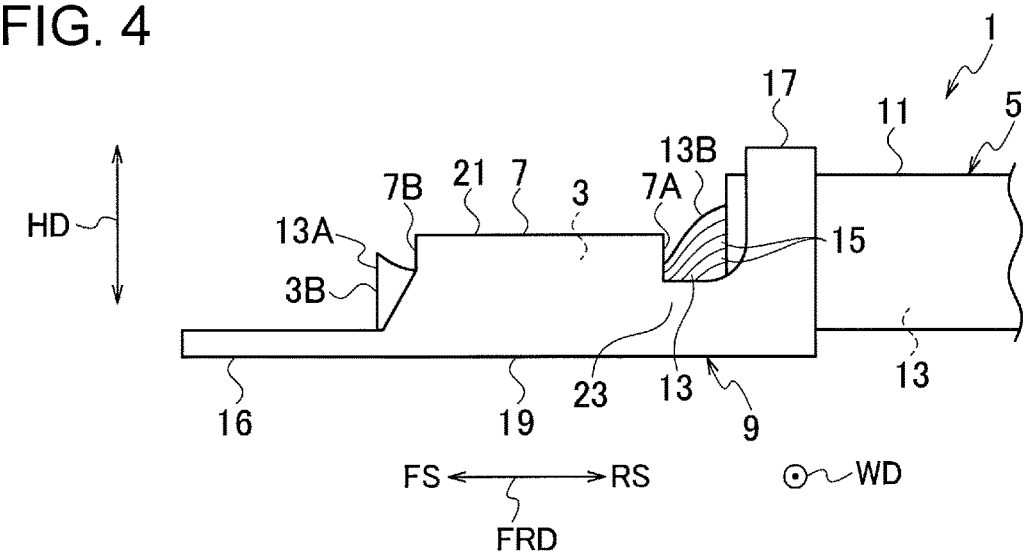
FIG. 4 is a view showing a schematic configuration of a terminal-equipped electric wire according to an embodiment of the present invention.
Figure 5:
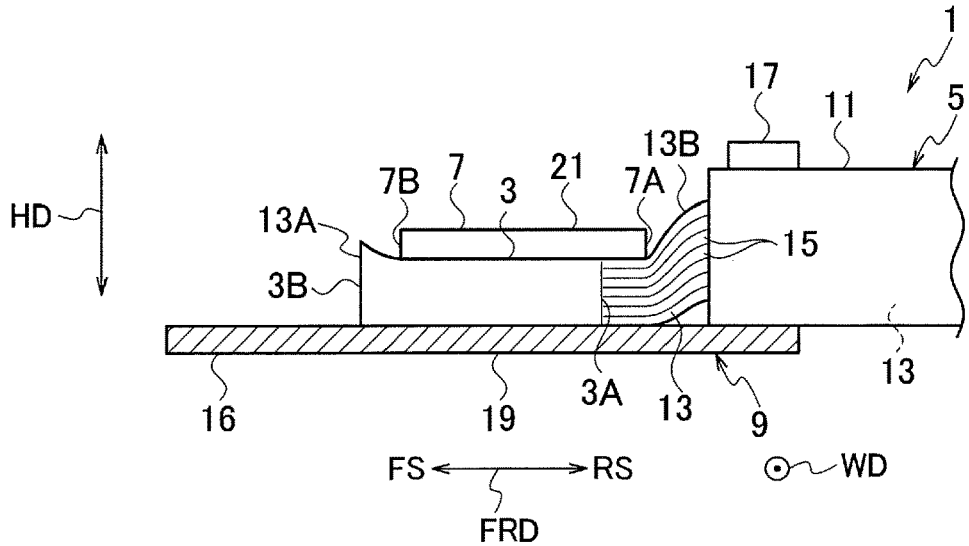
FIG. 5 is a cross-sectional view showing a schematic configuration of a terminal-equipped electric wire according to an embodiment of the present invention.

As shown in FIGS. 3 to 5, a terminal equipped electric wire 1 according to an embodiment of the present invention includes an electric wire 5 on which a bonded portion 3 (bonding region) is formed, and a terminal 9 (terminal fitting) having the wire barrel 7.

Here, for convenience of explanation, a predetermined direction of the terminal-equipped electric wire 1 is defined as the front-rear direction, a predetermined direction orthogonal to the front-rear direction is defined as the height direction, and a direction orthogonal to the front-rear direction and the height direction is defined as the width direction. In FIGS. 3 to 11, FRD, HD, WD, FS and RS indicate the front-rear direction, the height direction, the width direction, the front side, and the rear side, respectively.

As described above, a conductor 13 is exposed due to absence of a sheath 11 over a predetermined length at part (for example, one end portion) of the electric wire 5 in the longitudinal direction (length direction) (for example, part of the sheath 11 is removed).

A bonded portion 3 to which the conductor 13 is bonded is formed over a predetermined length at part of the exposed conductor 13A (exposed conductor) of the electric wire 5. The bonded portion 3 is formed by, for example, ultrasonically bonding (ultrasonic wave treatment) a plurality of strands 15 constituting the conductor 13.

More specifically, the electric wire 5 includes the conductor 13 (core wire) formed by collecting a plurality of strands 15 and a sheath 11 (insulator) covering (sheathing) the conductor 13.

The strands 15 of the conductor 13 are formed in an elongated columnar shape with a metal such as copper, aluminum, aluminum alloy or the like. The conductor 13 is configured in a form in which a plurality of strands 15 are twisted or in a form in which a plurality of strands 15 linearly extend in a lump.

Further, the electric wire 5 has flexibility. A cross section (a cross section which is a plane orthogonal to the longitudinal direction) of a portion of the electric wire 5 where the sheath 11 is present is formed in a predetermined shape such as a circular shape.

The cross section of the conductor 13 at the portion of the electric wire 5 where the sheath 11 is present is, for example, formed in a substantially circular shape because the plurality of strands 15 are bundled with almost no gaps. The cross section of the sheath 11 at the portion of the electric wire 5 where the sheath 11 is present is, for example, formed in an annular shape having a predetermined width (thickness). The entire circumference of the inner periphery of the sheath 11 is in contact with the entire circumference of the outer periphery of the conductor 13.

In the bonded portion 3, the plurality of strands 15 constituting the conductor 13 are ultrasonically bonded to each other as described above, whereby the conductor 13 is made into a single line, for example.

In the above description, the bonded portion 3 is formed by the ultrasonic bonding. The bonded portion 3 may be formed by bonding the strands 15 by a bonding method other than ultrasonic bonding. For example, the strands 15 may be metallurgically bonded to each other at a temperature equal to or lower than the recrystallization temperature of the strand 15, whereby the bonded portion 3 may be formed in the same manner as in the case of the ultrasonic bonding.

Further, the bonded portion 3 may be formed by a process other than ultrasonic wave treatment, such as cold welding, friction stir welding, friction pressure welding, electromagnetic pressure welding, diffusion bonding, brazing, soldering, resistance welding, electron beam welding, laser welding, light beam welding or the like.

The bonded portion 3 and the sheath 11 are away from each other by a predetermined length in the longitudinal direction of the electric wire 5, for example. As a result, a plurality of strands 13B (conductors in a non-bonded state) which is in contact with each other, but is in a non-bonded state is exposed between the bonded portion 3 and the sheath 11.

That is, the bonded portion 3 having a predetermined length, the conductor 13B in a non-bonded state, and the conductor 13 covered with the sheath 11 (a portion of the electric wire 5 where the sheath 11 is present) are arranged in this order from the one end toward the other end of the electric wire 5 in the longitudinal direction.

The cross-sectional shape (sectional shape represented by a plane orthogonal to the longitudinal direction) of the bonded portion 3 before the terminal 9 is installed (fixed) is formed in a predetermined shape such as a circular shape or a rectangular shape.

In addition, the cross-sectional shape (cross-sectional shape represented by a plane orthogonal to the longitudinal direction) of the conductor 13B in a non-bonded state before the terminal 9 is installed, gradually shifts from the sectional shape of the bonded portion 3 to the cross-sectional shape of the conductor 13 covered with the sheath 11.

In the terminal-equipped electric wire 1, the longitudinal direction of the electric wire 5 and the conductor 13, and the front-rear direction of the wire barrel 7 (the terminal 9) match with each other. One end of the electric wire 5 in the longitudinal direction is located on the front side, and the other end of the electric wire 5 in the longitudinal direction is located on the rear side.

Further, in the terminal-equipped electric wire 1, an end 7A (rear end: the end located on the sheath 11 side in the front-rear direction) of the wire barrel 7 of a terminal 9 is located on the sheath 11 side (rear side) relative to the end 3A (rear end; end located on the sheath 11 side in the longitudinal direction) of the bonded portion 3. In the terminal-equipped electric wire 1, for example, by caulking the wire barrel 7 the wire barrel 7 wraps and covers at least part of the bonded portion 3. By the caulking, almost the entire inner surface of the cylinder of the wire barrel 7 is in contact with the bonded portion 3 with an urging force.

The terminal 9 is formed, for example, by forming a flat metal material in a predetermined shape and then folding the terminal formed in the predetermined shape.

For example, a terminal connection portion 1G connected to the mating terminal, the wire barrel 7 and an insulation barrel portion 17 are arranged in this order from the front side to the rear side of the terminal 9.

For example, the sectional shape of the wire barrel 7 (the cross-sectional shape represented by a plane orthogonal to the front-rear direction) before being caulked is, for example, formed in a U-shape with a bottom plate portion 19 (arc-shaped bottom plate portion) in which the thickness direction is substantially the height direction, and a pair of side plate portions 21. Each of the pair of side plate portions 21 stands obliquely upward from both ends of the bottom plate portion 19 in the width direction. The dimension value (dimension value in the width direction) between the pair of side plate portions 21 gradually increases from the lower side to the upper side.

The sectional shape of the insulation barrel portion 17 before being caulked (the sectional shape represented by a plane orthogonal to the front-rear direction) is also formed in a U-shape similar to the cross section of the wire barrel 7.

In the terminal-equipped electric wire 1, as the wire barrel 7 is caulked, the bonded portion 3 and the wire barrel 7 are integrated with each other, and as the insulation barrel portion 17 is caulked, the sheath 11 and the insulation barrel portion 17 are integrated with each other.

The caulking of the wire barrel 7 and the insulation barrel portion 17 is mainly performed by plastically deforming the pair of side plate portions 21 and making the wire barrel 7 and the insulation barrel portion 17 into a cylindrical shape. By caulking the wire barrel 7, the bonded portion 3 is deformed.

Further, in the front-rear direction, for example, the wire barrel 7 and the insulation barrel portion 17 are slightly away from each other (connection portion 23 is provided therebetween). The wire barrel 7 may be in contact with the insulation barrel portion 17.

Here, the relationship between the electric wire 5 and the terminal 9 in the front-rear direction will be described in more detail.

In the longitudinal direction of the electric wire 5, as described above, from the front side to the rear side, the bonded portion 3 having a predetermined length, the conductor 13B in a non-bonded state, and the conductor 13 covered with the sheath 11 are arranged in this order. The length of the conductor 13 covered with the sheath 11 is much longer than the length of the bonded portion 3 or the conductor 13B in the non-bonded state.

In the front-rear direction of the terminal 9, as described above, from the front side to the rear side, the terminal connection portion 16, the wire barrel 7, the connection portion 23 between the wire barrel 7 and the insulation barrel portion 17, and the insulation barrel portion 17 are arranged in this order. The dimension value of the wire barrel 7 in the front-rear direction is larger than the dimension value of the connection portion 23 and the insulation barrel portion 17 in the front-rear direction.

In the terminal-equipped electric wire 1, as shown in FIG. 5 etc., in the front-rear direction, one end 3B (front end) of the bonded portion 3 is located slightly on the front side relative to the front end 7B of the wire barrel 7. Thus, one end portion of the bonded portion 3 protrudes slightly forward from the front end 7B of the wire barrel 7. The value of the protrusion dimension of the bonded portion 3 from the wire barrel 7 (protrusion amount toward the front side) is smaller than the value of the height dimension of the bonded portion 3.

One end 3B (front end) of the bonded portion 3 may be located slightly on the rear side relative to the front end 7B of the wire barrel 7.

The other end 3A (rear end) of the bonded portion 3 is located slightly on the front side relative to the rear end 7A of the wire barrel 7. As a result, the wire barrel 7 encapsulates the front end portion of the conductor 13B in the non-bonded state between the bonded portion 3 and the sheath 11.

The dimension value (the dimension value in the front-rear direction) between the rear end 3A of the bonded portion 3 and the rear end 7A of the wire barrel 7 is also smaller than the value of the height dimension of the bonded portion 3.

In the terminal-equipped electric wire 1, the value of the height dimension of the conductor 13B in the non-bonded state gradually increases from the front side to the rear side. The front end (the rear end of the conductor 13B in the non-bonded state) of the sheath 11 of the electric wire 5 is located slightly on the front side relative to the front end of the insulation barrel portion 17.

Here, a method of manufacturing the terminal-equipped electric wire 1 will be described. The terminal-equipped electric wire 1 is manufactured through a bonded portion forming process and a terminal installing (fixing) process.

In the bonded portion forming process, the conductor 13 is bonded at part of the exposed conductor 13A in the longitudinal direction to form the bonded portion 3.

Subsequently, after forming the bonded portion 3 in the bonded portion forming process, as shown in FIG. 3, the electric wire 5 is positioned with respect to the terminal 9.

Subsequently, in the terminal installing process, the wire barrel 7 and the insulation barrel portion 17 are caulked, and the terminal 9 is installed on the electric wire 5. At this time, the rear end 7A of the wire barrel 7 is located on the rear side relative to the rear end 3A of the bonded portion 3, and the wire barrel 7 wraps and covers at least part of the bonded portion 3.

According to the terminal-equipped electric wire 1, since the wire barrel 7 covers the bonded portion 3 so that the rear end 7A of the wire barrel 7 is located on the rear side relative to the rear end 3A of the bonded portion 3, it is possible to suppress cut of the strand 15 at the boundary portion 3A (boundary between the bonded portion 3 and the conductor 13B in the non-bonded state) of the bonded portion 3.

That is, when caulking the wire barrel 7 to the electric wire 5 forming the bonded portion 3 and crimping the terminal 9, since the rear end 3A (boundary portion between the bonded portion and the conductor in the non-bonded state) of the bonded portion 3 is located within the wire barrel 7, the boundary portion 3A is hardly pulled by the crimping of the terminal 9, so that it is possible to suppress cut of the core wire at the boundary portion 3A (cut of the strand 15 even in the non-bonded state conductor 13B).

By suppressing cut of the strand 15, the performance of the crimping part is stabilized (the degree of mechanical bonding and the degree of electrical bonding between the electric wire 5 and the terminal 9 are stabilized), and the occurrence of contamination is suppressed.

Figure 6:
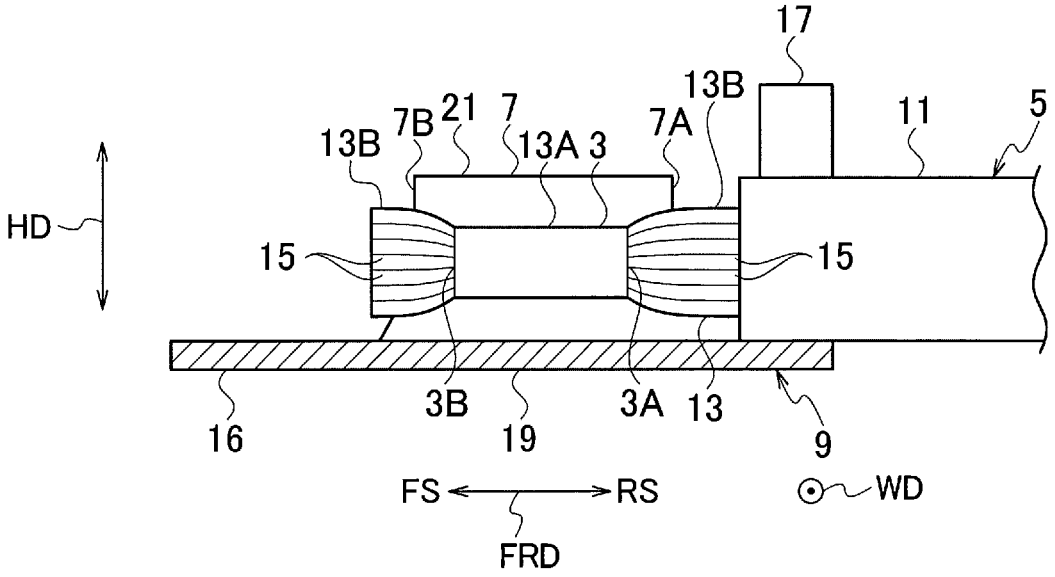
FIG. 6 is a view of a terminal-equipped electric wire according to a modification and shows a state before a terminal is installed on an electric wire.

In the above description, as shown in FIG. 5 and the like, the bonded portion 3 protrudes slightly forward from the front end 7B of the wire barrel 7. As shown in FIG. 6, the front end 7B of the wire barrel 7 may be located on the front side relative to the front end 3B of the bonded portion 3. That is, the dimension value of the wire barrel 7 in the front-rear direction is larger than the dimension value of the bonded portion 3 in the front-rear direction. In the front-rear direction, the bonded portion 3 may be located inside the wire barrel 7.

Also, in FIG. 6, the conductor 13B in the non-bonded state protrudes slightly forward from the front end 3B of the bonded portion 3. The conductor 13B in the non-bonded state protruding forward from the front end 3B of the bonded portion 3 may be eliminated.

According to the terminal-equipped electric wire 1 shown in FIG. 6, since the bonded portion 3 is located inside the wire barrel 7 in the front-rear direction, cut of the strand 15 at both ends (the rear end 3A and the front end 3B) of the bonded portion 3 can be suppressed.

Figure 7:
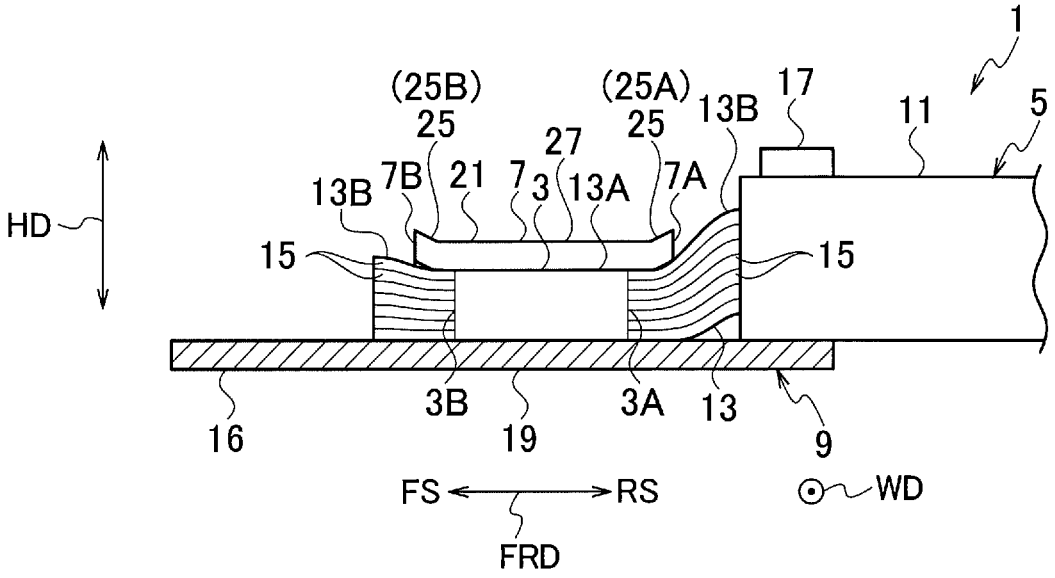
FIG. 7 is a cross-sectional view showing a schematic configuration of a terminal-equipped electric wire according to a modification.
Figure 8:
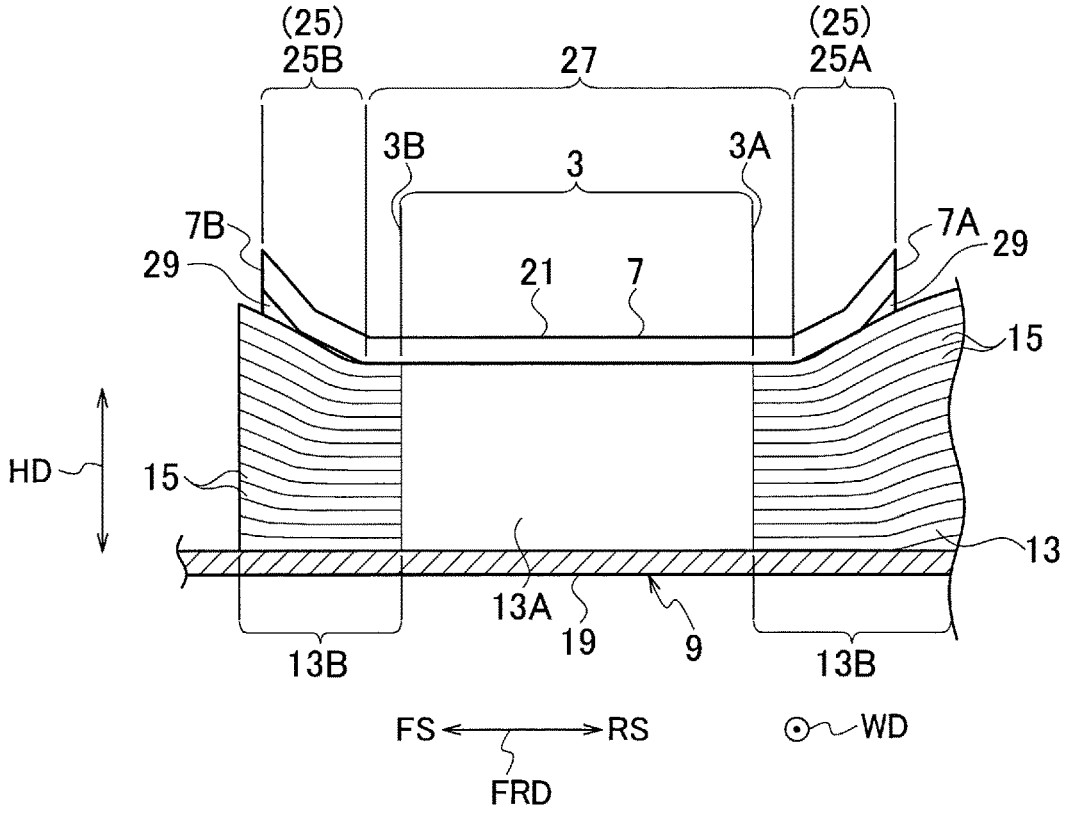
FIG. 8 is a view schematically showing the terminal-equipped electric wires of FIG. 7.
Figure 9:
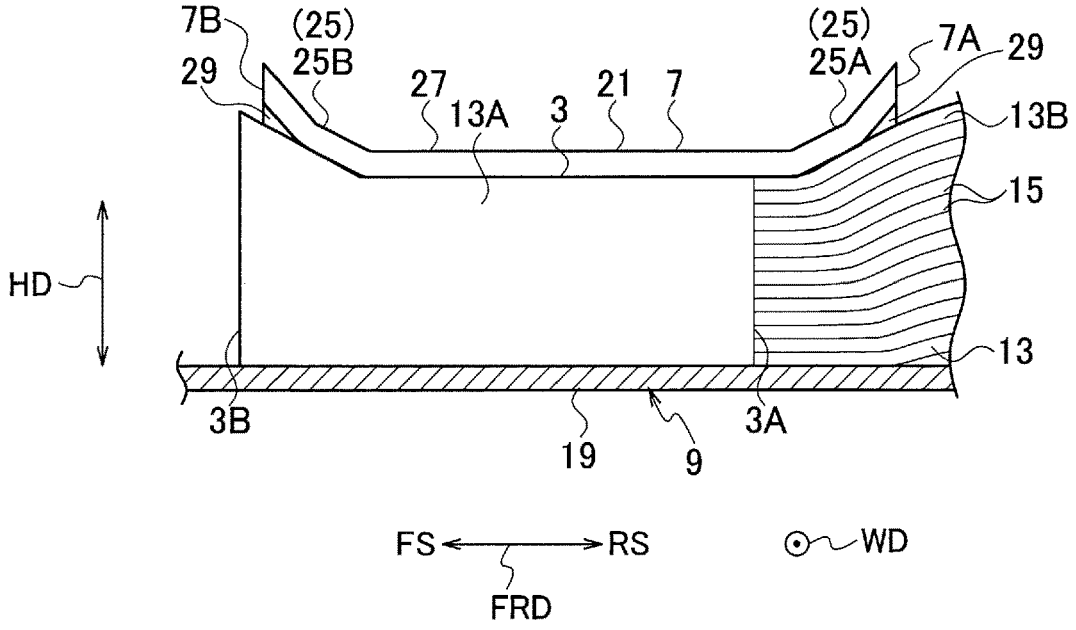
FIG. 9 is a view schematically showing a modification of the terminal-equipped electric wire of FIG. 7.

In the terminal-equipped electric wire 1 shown in FIGS. 3 to 6 the wire barrel 7 is not provided with a bell mouth portion. As shown in FIGS. 7 to 9, a bell mouth portion 25 may be provided on the wire barrel 7.

In this case, the bell mouth portion 25 is provided in a mode in which it protrudes rearward from the rear end 7A of the wire barrel 7 of the terminal-equipped electric wire 1 shown in FIGS. 3 to 6, and in a mode in which it protrudes forward from the front end 7B of the wire barrel 7 of the terminal-equipped electric wire 1 shown in FIGS. 3 to 6.

In the terminal-equipped electric wire 1 shown in FIGS. 7 and 8, the wire barrel 7 includes a main body portion 27 and a pair of bell mouth portions 25 (a rear bell mouth portion 25A and a front bell mouth portion 25B). In the front-rear direction, the front bell mouth portion 25B, the main body portion 27, and the rear bell mouth portion 25A are arranged in this order from the front side to the rear side.

More specifically, the bell mouth portion 25 (rear bell mouth portion 25A) is formed at an end portion (rear end portion) of the wire barrel 7 located on the sheath 11 side.

In the terminal-equipped electric wire 1 shown in FIGS. 7 and 8, the front end of the rear bell mouth portion 25A (the end opposite to the rear end located on the sheath 11 side in the front-rear direction; the boundary between the rear bell mouth portion 25A and the main body portion 27) is located on the sheath 11 side (rear side) relative to the rear end 3A (the end located on the sheath 11 side in the longitudinal direction) of the bonded portion 3.

In the terminal-equipped electric wire 1 shown in FIGS. 7 and 8, the main body portion 27 of the wire barrel 7 is formed in a cylindrical shape whose diameter is substantially constant in the front-rear direction. The rear bell mouth portion 25A is formed in a cylindrical shape having a gradually increasing diameter as it is farther from the main body portion 27 (from the front side toward the rear side). The diameter of the front end of the rear bell mouth portion 25A (the diameter at the boundary with the main body portion 27) is the same as the diameter of the main body portion 27.

In the terminal-equipped electric wire 1 shown in FIGS. 7 and 8, as in the rear bell mouth portion 25A, the front bell mouth portion 25B is formed in a cylindrical shape having a gradually increasing diameter as it is away from the main body portion 27 (from the rear side toward the front side).

Further, in the terminal-equipped electric wire 1 shown in FIGS. 7 and 8, in the front-rear direction, the conductor 13 which is present between the main body portion 27 of the wire barrel 7 and the sheath 11 (the rear conductor 13B in the non-bonded state located between the front end of the rear bell mouth portion 25A and the sheath 11) has a height dimension and a diameter value which gradually become larger as they go rearward.

In the terminal-equipped electric wire 1 shown in FIGS. 7 and 8, from the front end of the bonded portion 3 of the electric wire 5, a conductor 13B (a conductor in a non-bonded state on the front side) in a non-bonded state protrudes forward by a predetermined length.

Consequently, with the terminal-equipped electric wire 1 shown in FIGS. 7 and 8, in the front-rear direction, the rear end (the boundary between the conductor 13B in the non-bonded state on the front side and the bonded portion 3) of the conductor 13B in the non-bonded state on the front side is located on the rear side relative to the rear end of the front bell mouth portion 25B, and the front end of the conductor 13B in the non-bonded state on the front side is located on the front side relative to the front end of the front bell mouth portion 25B.

Further, as shown in FIG. 8, at the front end (opening at the front end) of the front bell mouth portion 25B, a slight gap 29 is formed between the conductor 13 (conductor 13B in a non-bonded state on the front side) and the front bell mouth portion 25B, and a slight gap 29 is also formed between the conductor 13 and the rear bell mouth portion 25A at the rear end (opening at the rear end) of the rear bell mouth portion 25A.

At the front end (opening at the front end) of the front bell mouth portion 25B, the front bell mouth portion 25B and the conductor 13 may be in contact with each other, and the front bell mouth portion 25B may suppress the conductor 13. At the rear end (opening at the rear end) of the rear bell mouth portion 25A, the rear bell mouth portion 25A may be in contact with the conductor 13, and the rear bell mouth portion 25A may suppress the conductor 13.

In the terminal-equipped electric wire 1 shown in FIGS. 7 and 8, either the rear bell mouth portion 25A or the front bell mouth portion 25B may be eliminated. For example, the front bell mouth portion 25B may be eliminated. In this case, in the terminal-equipped electric wire 1, in the front-rear direction, the rear end of the front conductor 13B in the non-bonded state is located on the rear side relative to the front end of the main body portion 27 of the wire barrel 7.

According to the terminal-equipped electric wire 1 shown in FIGS. 7 and 8, since the bonded portion 3 is located inside the main body portion 27 (the main body portion excluding the bell mouth portion 25) of the wire barrel 7, cut of the conductor 13 when the terminal 9 is installed in the electric wire 5 can be suppressed.

Further, according to the terminal-equipped electric wire 1 shown in FIG. 7 and FIG. 8, since part (a portion on the bonded portion 3 side) of the conductor 13B in the non-bonded state is contained within the bell mouth portion 25, it is possible to further suppress cut of the conductor 13 at the boundary portion between the bonded portion 3 and a non-bonded portion 13B.

In the terminal-equipped electric wire 1 shown in FIGS. 7 and 8 in which the bell mouth portion 25 is provided, the bonded portion 3 is located inside the main body portion 27 of the wire barrel 7. However, in the front-rear direction, the front end of the bonded portion 3 may be located in the intermediate portion of the front bell mouth portion 25B, and the rear end of the bonded portion 3 may be located in the intermediate portion of the rear bell mouth portion 25A.

Further, as shown in FIG. 9, a configuration in which the front conductor 13B in the non-bonded state is eliminated may be employed. In the terminal-equipped electric wire 1 shown in FIG. 9, the front end of the bonded portion 3 is located on the front side relative to the front end of the front bell mouth portion 25B. The front end of the bonded portion 3 may be located on the rear side relative to the rear end of the front bell mouth portion 25B, and the front end of the bonded portion 3 may be located at the front bell mouth portion 25B.

Figure 10:
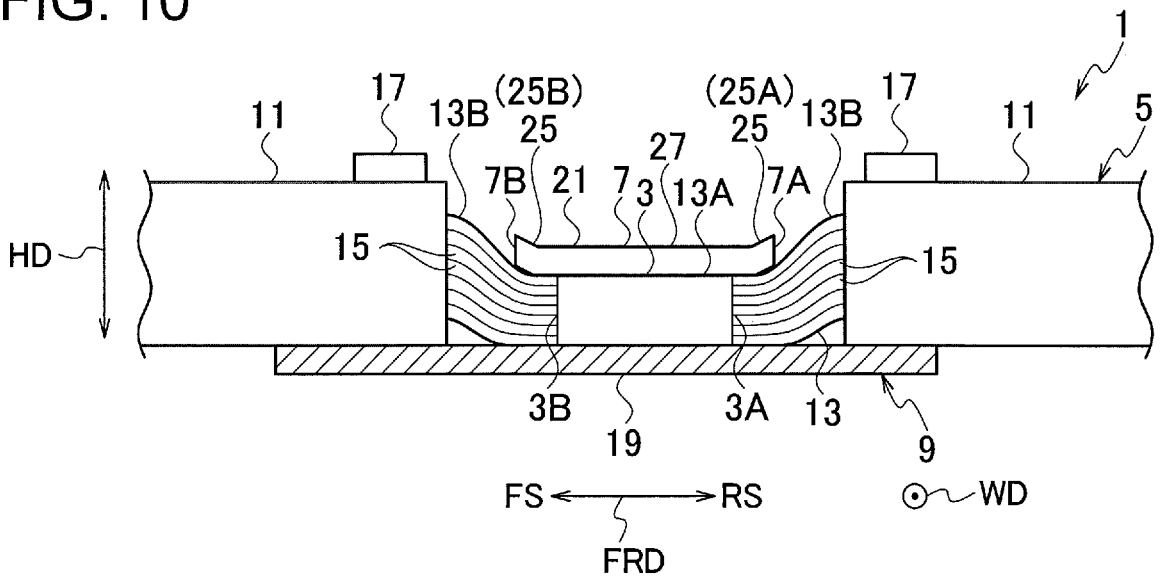
FIG. 10 is a view of a terminal-equipped electric wire according to a modification in which a bonded portion is formed at an intermediate portion in the longitudinal direction of the electric wire and a terminal is installed thereon.

In the above description, the bonded portion 3 is formed at one end portion in the longitudinal direction of the electric wire 5, and the terminal 9 is installed therein. However, as shown in FIG. 10, the bonded portion 3 may be formed at the intermediate portion of the electric wire 5 in the longitudinal direction, and the terminal 9 may be installed therein.

More specifically, the terminal 9 may be installed at the bonded portion 3 of the electric wire in which, from one side of the electric wire 5 in the longitudinal direction to the other side, the conductor 13 (one end side portion of the electric wire in which the sheath is present) covered with the sheath 11, the conductor 13B (conductor in a non-bonded state on one end side) in the non-bonded state, bonded portion 3, a conductor 13B (conductor in the non-bonded state on the other end side) in the non-bonded state, and the conductor 13 covered with the sheath 11 (the other end side portion of the electric wire in which the sheath is present) are arranged in this order.

In such a terminal-equipped electric wire, in the longitudinal direction of the electric wire 5 (the front-rear direction of the terminal 9), the value of the length dimension of the wire barrel 7 (or the main body portion 27 of the wire barrel) of the terminal 9 is larger than the value of the length dimension of the bonded portion 3, and, in the longitudinal direction of the electric wire 5 (the front-rear direction of the terminal 9), the bonded portion 3 is located inside the wire barrel 7 (or the main body portion 27 of the wire barrel) of the terminal 9.

Figure 11:
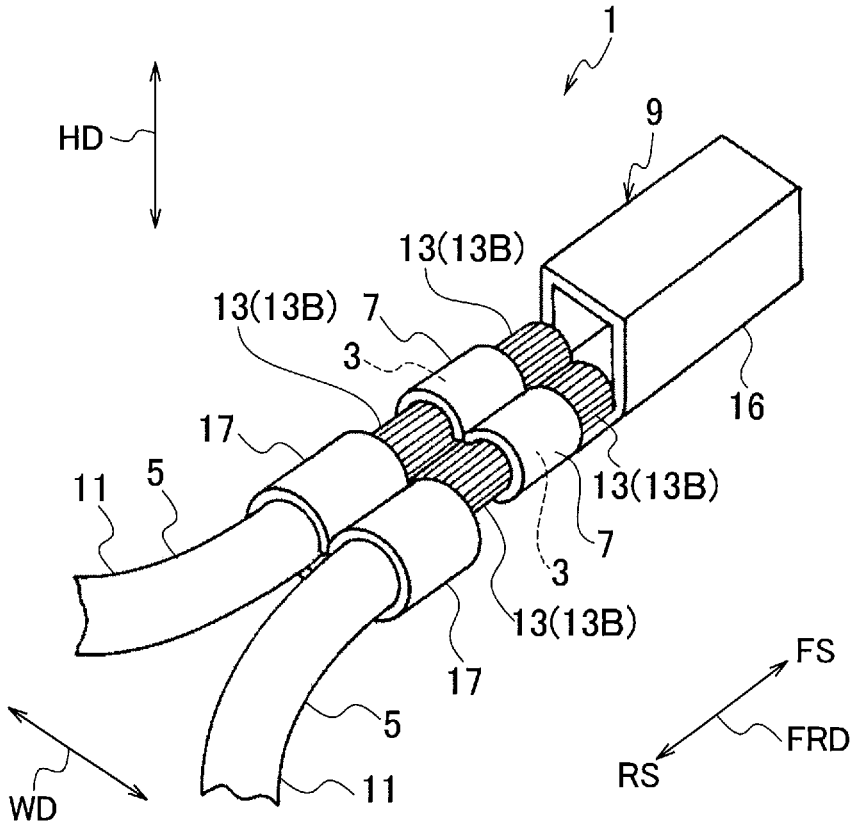
FIG. 11 is a view of a terminal-equipped electric wire according to a modification in which one terminal is installed on a plurality of (for example, two) electric wires.

Furthermore, in the above description, one terminal 9 is provided on one electric wire 5. As shown in FIG. 11, one terminal 9 may be provided for a plurality of (for example, two) electric wires 5. That is, as in the case described above, the wire barrel 7 may be installed at the bonded portion 3 of each electric wire 5 so that the bonded portion 3 of each electric wire 5 is placed inside the wire barrel 7 (or the main body portion 27 of the wire barrel) of one terminal 9.

Further, when one terminal 9 is installed for a plurality of electric wires 5, a bonded portion 3 may be individually formed on the conductor 13 of each electric wire 5 and one terminal 9 may be provided for each electric wire 5. The conductors 13 of at least two the electric wires 5 among the electric wires 5 may be collected, a bonded portion 3 may be formed on the collected conductors, and one terminal 9 may be provided for each electric wire 5.

Further, when one terminal 9 is installed for a plurality of electric wires 5, with at least one electric wire 5 among the electric wires 5, the bonded portion 3 may be formed at an intermediate portion of the electric wire 5 in the longitudinal direction.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A terminal-equipped electric wire comprising:

at least one electric wire including a sheath, a conductor having a covered portion covered by the sheath and an exposed portion exposed due to absence of the sheath over a predetermined length at a part of the electric wire in a longitudinal direction of the electric wire, and a bonded portion formed over a predetermined length at a part of the exposed portion, the bonded portion at which strands of the conductor are bonded; and a terminal including a wire barrel and installed on the electric wire, wherein an end of the wire barrel on a sheath side is closer to the sheath than an end of the bonded portion on the sheath side, and the wire barrel covers at least a part of the bonded portion.

2. The terminal-equipped electric wire according to claim 1, wherein an end portion of the wire barrel on the sheath side comprises a bell mouth portion, the bell mouth portion comprises a first end on the sheath side and a second end opposite to the first end, and the second end is closer to the sheath than the end of the bonded portion on the sheath side.

3. The terminal-equipped electric wire according to claim 1, wherein the longitudinal direction and a front-rear direction of the wire barrel match with each other, and the bonded portion is located inside the wire barrel in the front-rear direction.

4. The terminal-equipped electric wire according to claim 1, wherein the at least one electric wire comprises electric wires, the terminal is a single terminal, and the single terminal is installed on the electric wires.

5. A method of manufacturing a terminal-equipped electric wire, the method comprising:

forming a bonded portion by bonding strands of a conductor at a part of an exposed portion of the conductor in a longitudinal direction of the electric wire, the exposed portion at which the conductor is exposed due to absence of a sheath over a predetermined length at a part of the electric wire in the longitudinal direction; and after the forming of the bonded portion, installing a terminal having a wire barrel on the electric wire so that the wire barrel covers at least part of the bonded portion wherein an end of the wire barrel located on a sheath side of the electric wire is located closer to the sheath than an end of the bonded portion on the sheath side.

6. The method according to claim 5, wherein an end portion of the wire barrel on the sheath side comprises a bell mouth portion, the bell mouth portion comprises a first end on the sheath side and a second end opposite to the first end, and the second end is closer to the sheath than the end of the bonded portion on the sheath side.

7. The method according to claim 5, wherein the longitudinal direction and a front-rear direction of the wire barrel match with each other, and the bonded portion is located inside the wire barrel in the front-rear direction.

8. The method according to claim 5, wherein the at least one electric wire comprises electric wires, the terminal is a single terminal, and the single terminal is installed on the electric wires.

* * * * *